US009286842B2

(12) United States Patent
Tanaka et al.

(10) Patent No.: US 9,286,842 B2
(45) Date of Patent: Mar. 15, 2016

(54) LIQUID CRYSTAL DISPLAY DEVICE

(75) Inventors: Yukio Tanaka, Kanazawa (JP); Kenji Nakao, Kanazawa (JP); Tetsuo Fukami, Ishikawa-gun (JP); Kazuhiro Nishiyama, Kanazawa (JP)

(73) Assignee: JAPAN DISPLAY INC., Tokyo (JP)

( * ) Notice: Subject to any disclaimer, the term of this patent is extended or adjusted under 35 U.S.C. 154(b) by 2735 days.

(21) Appl. No.: 11/526,733

(22) Filed: Sep. 26, 2006

(65) Prior Publication Data

US 2007/0103425 A1 May 10, 2007

(30) Foreign Application Priority Data

Sep. 28, 2005 (JP) ..... 2005-281822
Jul. 5, 2006 (JP) ..... 2006-185813
Sep. 20, 2006 (JP) ..... 2006-254251

(51) Int. Cl.
*G09G 3/36* (2006.01)
*G09G 3/34* (2006.01)

(52) U.S. Cl.
CPC ..... *G09G 3/3648* (2013.01); *G09G 3/3406* (2013.01); *G09G 3/3607* (2013.01); *G09G 3/3614* (2013.01); *G09G 2310/0218* (2013.01); *G09G 2310/0237* (2013.01); *G09G 2310/0283* (2013.01); *G09G 2310/063* (2013.01); *G09G 2320/0247* (2013.01); *G09G 2330/021* (2013.01)

(58) Field of Classification Search
CPC ..... G02F 1/1336; G09G 3/3406–3/342; G09G 3/36–3/3696; G09G 2310/061
USPC ..... 345/87–104
See application file for complete search history.

(56) References Cited

U.S. PATENT DOCUMENTS 5,757,352 A * 5/1998 Miyamoto et al. ..... 345/101
6,215,465 B1 * 4/2001 Asakura et al. ..... 345/87
7,030,848 B2 * 4/2006 Sato et al. ..... 345/95

(Continued)

FOREIGN PATENT DOCUMENTS

CN 1385830 A 12/2002
CN 1410958 A 4/2003

(Continued)

OTHER PUBLICATIONS

Kobayashi et al., "An LCD for the multimedia network age: Polymer stabilized FLCD," Jul. 1999, Pramana Journal of Physics, vol. 53, No. 1, pp. 145-153.*

(Continued)

*Primary Examiner* — Amr Awad
*Assistant Examiner* — Aaron Midkiff
(74) *Attorney, Agent, or Firm* — Oblon, McClelland, Maier & Neustadt, L.L.P

(57) ABSTRACT

A liquid crystal display device which includes a plurality of OCB liquid crystal pixels arrayed substantially in a matrix, and a driver circuit which cyclically writes a non-video signal and a video signal as a pixel voltage in each of the liquid crystal pixels. The liquid crystal display device further includes a control circuit which sets a first period and a second period different in length from the first period such that a total time length of the first period and the second period does not exceed one frame period, and controls the driver circuit to execute write of the non-video signal for the liquid crystal pixels in the first period and to execute write of the video signal for the liquid crystal pixels PX in the second period.

7 Claims, 13 Drawing Sheets

(56) References Cited

U.S. PATENT DOCUMENTS

| | | | | |
|---|---|---|---|---|
| 2001/0035852 | A1* | 11/2001 | Yoshihara et al. | 345/87 |
| 2002/0149576 | A1* | 10/2002 | Tanaka et al. | 345/204 |
| 2002/0196220 | A1* | 12/2002 | Sato et al. | 345/87 |
| 2003/0006948 | A1* | 1/2003 | Son et al. | 345/87 |
| 2003/0107543 | A1* | 6/2003 | Nakano et al. | 345/90 |
| 2005/0281822 | A1 | 12/2005 | Cedarbaum et al. | |

FOREIGN PATENT DOCUMENTS

| | | | |
|---|---|---|---|
| CN | 1425948 | A | 6/2003 |
| JP | 4-350894 | | 12/1992 |
| JP | 7-199149 | | 8/1995 |
| JP | 8-305316 | | 11/1996 |
| JP | 2000-330519 | | 11/2000 |
| JP | 2001-60078 | | 3/2001 |
| JP | 2002-55657 | | 2/2002 |
| JP | 2002-202491 | | 7/2002 |
| JP | 2003-215535 | | 7/2003 |
| JP | 2003-228346 | | 8/2003 |
| JP | 2003-248463 | | 9/2003 |
| JP | 2003-259395 | | 9/2003 |
| JP | 2003-295156 | | 10/2003 |
| JP | 2003-295157 | | 10/2003 |
| JP | 2003-295834 | | 10/2003 |
| JP | 2004-46236 | | 2/2004 |
| JP | 2004-198493 | | 7/2004 |
| JP | 2005-128153 | | 5/2005 |
| JP | 2006-39459 | | 2/2006 |
| TW | 554325 | | 9/2003 |
| TW | 583617 | | 4/2004 |

OTHER PUBLICATIONS

U.S. Appl. No. 11/555,929, filed Nov. 2, 2006, Tanaka, et al.
U.S. Appl. No. 12/877,551, filed Sep. 8, 2010, Tanaka, et al.
Office Action issued May 24, 2011 in Taiwanese Application No. 095136038 (w/English translation).
Office Action issued Jun. 22, 2011 in Japanese Application No. 2006-254251 filed Sep. 20, 2006 (w/English translation).
Office Action issued Dec. 20, 2011 in Japanese Application No. 2006-254251 filed Sep. 20, 2006 (w/English translation).
U.S. Appl. No. 13/220,932, filed Aug. 30, 2011, Tanaka, et al.
Office Action mailed Oct. 29, 2013, in Japanese Patent Application No. 2011-184572 (with English-language translation).

* cited by examiner

| Frame frequency (Hz) | 60 | 65 | 70 | 75 | 80 | 85 | 90 |
|---|---|---|---|---|---|---|---|
| Number of subjects who responded that they were conscious of flicker in first embodiment | 26 | 10 | 2 | 0 | 0 | 0 | 0 |
| Number of subjects who responded that they were conscious of flicker in second embodiment | 25 | 13 | 2 | 0 | 0 | 0 | 0 |

LIQUID CRYSTAL DISPLAY DEVICE

CROSS-REFERENCE TO RELATED APPLICATIONS

This application is based upon and claims the benefit of priority from prior Japanese Patent Applications No. 2005-281822, filed Sep. 28, 2005; No. 2006-185813, filed Jul. 5, 2006; and No. 2006-254251, filed Sep. 20, 2006, the entire contents of all of which are incorporated herein by reference.

BACKGROUND OF THE INVENTION

1. Field of the Invention

The present invention relates generally to a liquid crystal display device in which a plurality of pixels arrayed substantially in a matrix are driven with polarities that are cyclically reversed, and more particularly to a liquid crystal display device in which a non-video signal and a video signal are cyclically written in each of liquid crystal pixels as a pixel voltage.

2. Description of the Related Art

In recent years, mobile products to which liquid crystal panels are built, such as small-sized game machines, portable PCs and mobile phones, have rapidly gained popularity.

In general, the liquid crystal display panel is configured such that a liquid crystal layer is held between an array substrate and a counter-substrate. In the case where the liquid crystal display panel is of an active matrix type, the array substrate includes a plurality of pixel electrodes arrayed substantially in a matrix, a plurality of gate lines disposed along the rows of pixel electrodes, a plurality of source lines disposed along the columns of pixel electrodes, and a plurality of pixel switching elements which are disposed near intersections of the gate lines and source lines. The gate lines are connected to a gate driver which drives the gate lines. The source lines are connected to a source driver which drives the source lines. The gate driver and source driver are controlled by a control circuit. Each of the pixel switching elements is composed of, e.g., a thin-film transistor (TFT). When the associated gate line is driven by the gate driver, the pixel switching element is made conductive, thereby applying a pixel voltage, which is set on the associated source line by the source driver, to the associated pixel electrode. The counter-substrate is provided with a common electrode which is opposed to the pixel electrodes disposed on the array substrate. A liquid crystal pixel is constituted by a pair of each pixel electrode and the common electrode, together with a pixel region which is a part of the liquid crystal layer located between these paired electrodes. A driving voltage for the pixel is a difference between a pixel voltage, which is applied to the pixel electrode, and a common voltage which is applied to the common electrode. Even after the pixel switching element is turned off, the driving voltage is held between the pixel electrode and the common electrode. The alignment state of liquid crystal molecules in the pixel region is set by an electric field obtained between the electrodes to control the transmittance of the pixel. The polarity reversal of the driving voltage is executed, for example, by cyclically reversing the polarity of the pixel voltage with the common voltage used as a reference. Thus, the direction of electric field is reversed to prevent non-uniform distribution of liquid crystal molecules in the liquid crystal layer.

In mobile products, the power consumption of a backlight, driving circuits, etc., needs to be reduced in order to enable long-time battery-powered operations. On the other hand, in the case of a product that uses a low response-speed liquid crystal such as a TN liquid crystal, a moving image blurs when it is viewed, and a good moving-image viewablity cannot be obtained. It is thus required to improve the display quality, as well as reducing the power consumption.

In the field of large-sized liquid crystal TVs, liquid crystal display panels of an optically compensated bend (OCB) mode, which has a high liquid crystal responsivity that is needed for displaying moving images, have begun to be adopted. This liquid crystal display panel performs a display operation by transitioning the alignment state of liquid crystal molecules from a splay alignment to a bend alignment in advance. In this case, the bend alignment tends to be reversely transitioned to the splay alignment if a voltage-non-applied state or a nearly voltage-non-applied state continues for a long time. In this type of liquid crystal display panel, black insertion driving is used to prevent the reverse transition to the splay alignment (see Jpn. Pat. Appln. KOKAI Publication No. 2002-202491). In this case, the liquid crystal display panel is driven so as to perform video signal display, for example, in about 80% of 1 frame period, and to perform black display (non-video signal display), with which a driving voltage is set at a maximum value, in the other about 20% of the 1 frame period. Since the black insertion driving provides a pseudo-impulse response of luminance in moving image display, like a CRT, the black insertion driving is effective in clearing retinal persistence occurring on a viewer's vision, thus making the movement of an object appear smoother. Therefore, the black insertion driving has attracted attention as a technique which remarkably improves the moving image viewablity.

For example, in the liquid crystal display panel in which the black insertion driving is executed, two write operations, that is, a black insertion write operation and a video signal write operation, are executed in 1 frame period in order to apply a pixel voltage to each of pixel electrodes. FIG. 15 shows timings of sequentially driving gate lines Y1, Y2, Y3, . . . , for black insertion writing and video signal writing. In this example of black insertion driving, the gate driver sequentially drives, as black insertion scanning, the gate lines Y1, Y2, Y3, . . . , by making use of a first half of 1 horizontal scanning period (1H) of a video signal, and further sequentially drives, as signal write scanning, the gate lines Y1, Y2, Y3, . . . , by making use of a second half of the 1 horizontal scanning period (1H) of the video signal. In the first half of the 1 horizontal scanning period (1H), the source driver drives all the source lines so that pixel voltages Vs for black insertion may be written in pixels for one line. In the second half of the 1 horizontal scanning period (1H), the source driver further drives all the source lines so that pixel voltages of the video signal may be written in pixels for another one line. In this case, the black insertion period for each pixel is equal to a period between the black insertion scanning and the signal write scanning.

The power consumption in the source driver is now considered. FIG. 16 shows a scanning diagram and a waveform of a source line potential obtained in a prior-art driving in which black insertion is not performed. FIG. 17 shows a scanning diagram and a waveform of a source line potential obtained in a prior-art driving in which black insertion is performed. The ordinate of the scanning diagram indicates a vertical scanning position corresponding to a gate line, which is driven in the liquid crystal display panel, and the abscissa indicates a time as a scanning timing at the vertical scanning position.

For example, in the case where a dot-reversal (or line-reversal) drive scheme is applied to the liquid crystal display panel, the source line is set at a potential corresponding to a pixel voltage which is reversed in polarity in every 1 horizontal scanning period (1H), for example. Since the source driver charges the source line in every 1 horizontal scanning period with a polarity which is reversed with the common voltage used as a reference, the power consumption, which is calculated by integrating the charge current on the time axis, is very high. If the dot-reversal (or line-reversal) drive scheme is changed to a column-reversal (or frame-reversal) drive scheme, the source driver charges the source line with a reverse polarity in every 1 frame period. The 1 frame period is much longer than the 1 horizontal scanning period. Thus, the power consumption, which is calculated by integrating the charge current on the time axis, is greatly reduced than in the dot-reversal (or line-reversal) drive scheme.

On the other hand, if black insertion is performed in the dot-reversal (or line-reversal) drive scheme, the source driver charges the source line with a reverse polarity in every 1 horizontal scanning period, as in the above-described case. Since the pixel voltage is set at a polarity which is reversed with the common voltage used as a reference in every 1 horizontal scanning period, the power consumption, which is calculated by integrating the charge current on the time axis, is very high. If black insertion is performed in the column-reversal (or frame-reversal) drive scheme, the pixel voltage is set at a reverse polarity in every 1 frame period, which is much longer than 1 horizontal scanning period. In particular, in a time period in which black insertion scanning and signal write scanning overlap, the pixel voltage shifts between a black level and a video level with a polarity which is reversed with the common voltage used as a reference in every 1 horizontal scanning period/2. Thus, unlike the case in which black insertion is not performed in the column-reversal (or frame-reversal) drive scheme, the power consumption, which is calculated by integrating the charge current on the time axis, cannot be greatly reduced.

As is clear from the above, in the case where the black insertion drive scheme is to be adopted in order to improve the moving image viewablity, it is easy to apply the black insertion drive scheme to products, such as large-sized liquid crystal TVs, in which restrictive conditions relating to power consumption are relaxed, but it is difficult to apply the black insertion drive scheme to mobile products in which restrictive conditions relating to power consumption are severe.

BRIEF SUMMARY OF THE INVENTION

The present invention has been made in consideration of the above-described problems, and the object of the invention is to provide a liquid crystal display device which can improve display quality while maintaining low power consumption.

According to an aspect of the present invention, there is provided a liquid crystal display device comprising: a plurality of liquid crystal pixels arrayed substantially in a matrix; a driver circuit which cyclically writes a non-video signal and a video signal as a pixel voltage in each of the liquid crystal pixels; and a control circuit which sets a first period and a second period different in length from the first period such that a total time length of the first period and the second period does not exceed one frame period, and controls the driver circuit to execute write of the non-video signal for the liquid crystal pixels in the first period and to execute write of the video signal for the liquid crystal pixels in the second period.

In this liquid crystal display device, the power consumption can be reduced by eliminating a repetition of polarity reversal, which occurs due to overlap between non-video signal write and video signal write. Further, the lengths of the first period and the second period are adjustable relative to each other in order to optimize the ratio of non-video signal display to video signal display. Therefore, the display quality can be improved while low power consumption is maintained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
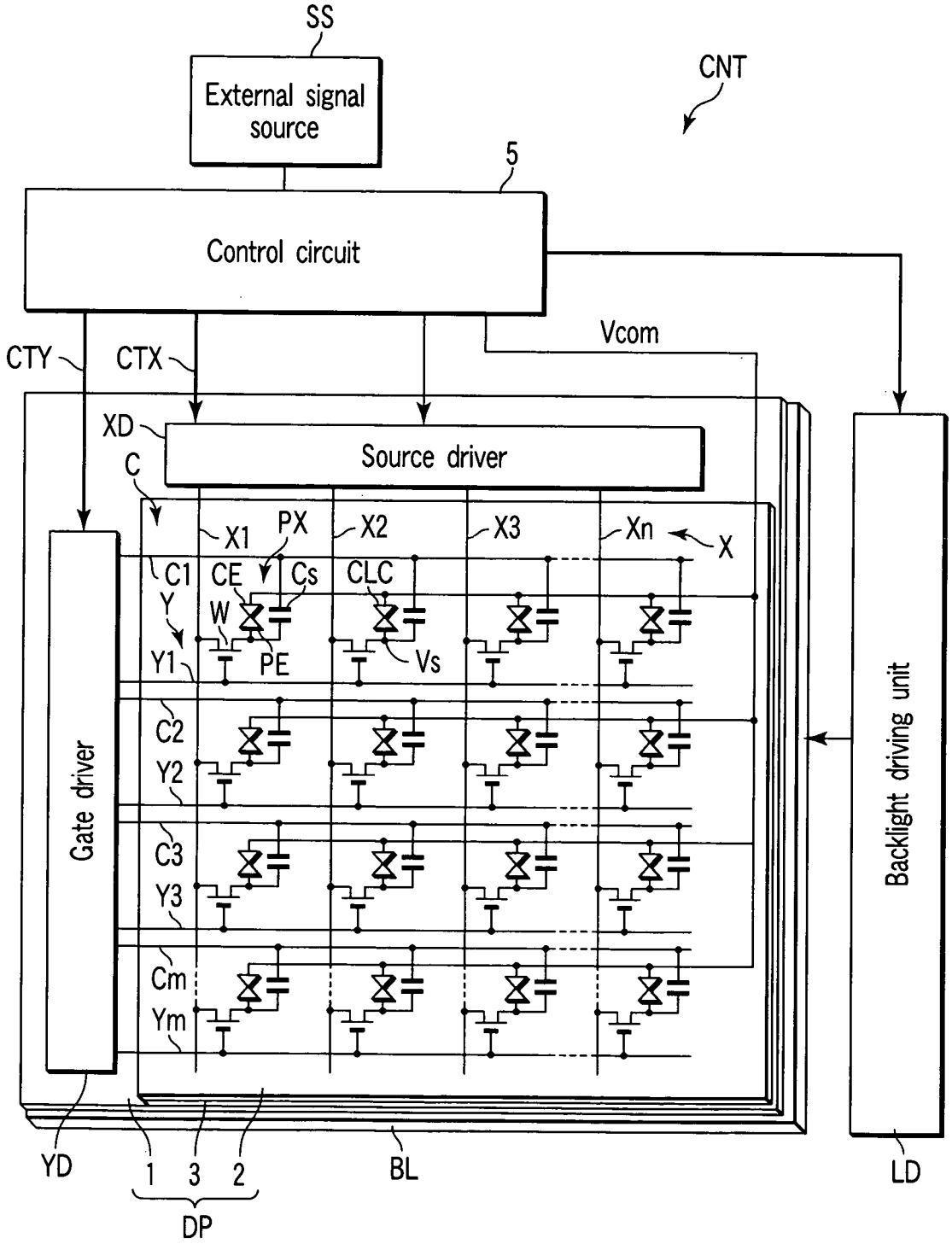
FIG. 1 schematically shows the circuit structure of a liquid crystal display device according to a first embodiment of the present invention.

A liquid crystal display device according to a first embodiment of the present invention will now be described with reference to the accompanying drawings. FIG. 1 schematically shows the circuit structure of this liquid crystal display device. The liquid crystal display device includes an OCB mode liquid crystal display panel DP, a backlight BL which illuminates the display panel DP, and a display control unit CNT which controls the display panel DP and backlight BL. The liquid crystal display panel DP is configured such that a liquid crystal layer 3 is held between an array substrate 1 and a counter-substrate 2, which are a pair of electrode substrates. The liquid crystal layer 3 includes a liquid crystal material such as a liquid crystal which requires transition to a bend alignment in advance from a splay alignment in order to perform a normally white display operation, for example. Reverse transition from the bend alignment to splay alignment is prevented by cyclically applying a driving voltage for black display to the liquid crystal layer 3.

The array substrate 1 includes a plurality of pixel electrodes PE arrayed substantially in a matrix on a transparent insulating substrate such as a glass substrate; a plurality of gate lines Y (Y1 to Ym) arranged along the rows of pixel electrodes PE; a plurality of source lines X (X1 to Xn) arranged along the columns of pixel electrodes PE; and a plurality of pixel switching elements W which are disposed near intersections of the gate lines Y and source lines X and are made conductive between the associated source lines X and associated pixel electrodes PE when the pixel switching elements W are driven via the associated gate lines Y. Each of the pixel switching elements W is composed of, e.g., a thin-film transistor. The thin-film transistor has a gate connected to the gate line Y and a source-drain path connected between the source line X and the pixel electrode PE.

The counter-substrate 2 includes a color filter which is disposed on a transparent insulating substrate such as a glass substrate and is formed of red, green and blue color layers, and a common electrode CE which is disposed on the color filter and is opposed to the pixel electrodes PE. Each of the pixel electrodes PE and the common electrode CE is formed of a transparent electrode material such as ITO to provide a transmissive type display. The pixel electrodes PE and the common electrode CE are covered with alignment films which are subjected to rubbing treatment in directions parallel to each other. An OCB liquid crystal pixel PX is constituted by each of the pixel electrodes PE and the common electrode CE together with a pixel region which is a part of the liquid crystal layer 3, and the alignment of the liquid crystal molecules therein are controlled by an electric field obtained between the pixel electrode PE and common electrode CE.

The OCB liquid crystal pixels PX includes liquid crystal capacitances CLC each of which is composed of the pixel electrode PE, the common electrode CE, and liquid crystal layer 3 located between the pixel electrode PE and the common electrode CE. Each of storage capacitance lines C1 to Cm is capacitive-coupled to the pixel electrodes PE of the liquid crystal pixels PX of the associated row to provide storage capacitances Cs.

The display control unit CNT includes a gate driver YD which sequentially drives the gate lines Y1 to Ym to turn on the switching elements W on a row-by-row basis; a source driver XD which outputs pixel voltages Vs to the source lines X1 to Xn during a time period in which the switching elements W of each row are made conductive by the driving of the associated gate line Y; a backlight driving unit LD which drives the backlight BL; and a control circuit 5 which controls the gate driver YD, source driver XD and backlight driving unit (inverter) LD.

The control circuit 5 is configured to perform an initializing process for transitioning liquid crystal molecules from the splay alignment to the bend alignment by applying a relatively high driving voltage to the liquid crystal layer 3 using a common voltage Vcom which is varied upon supply of power. The control circuit 5 outputs a control signal CTY, which is generated on the basis of a sync signal input from an external signal source SS, to the gate driver YD. The control circuit 5 also outputs to the source driver XD a control signal CTX, which is generated on the basis of the sync signal input from the external signal source SS, and a video signal input from the external signal source SS or a non-video signal for black insertion. Further, the control circuit 5 outputs a common voltage Vcom to be applied to the counter- or common electrode CE of the counter-substrate CT. In the control circuit 5, first and second periods are set in one frame period without any overlap, on the basis of the sync signal input from the external signal source SS. The second period differs in length from the first period. The first period is used to write a non-video signal for black insertion in the liquid crystal pixels PX. The second period is used to write a video signal in the liquid crystal pixels PX. The total length of the first period and second period is equal to one frame period.

Under the control of the control signal CTY, the gate driver YD sequentially drives the gate lines Y1 to Ym in the first period to sequentially select the rows of liquid crystal pixels PX as black insertion scanning. In the second period following the first period, the gate driver YD sequentially drives the gate lines Y1 to Ym to sequentially select the rows of liquid crystal pixels PX, as video signal write scan. On the other hand, in the first period, the source driver XD outputs a non-video signal for one row, as black-level pixel voltages Vs, while each of the gate lines Y1 to Ym is being driven. In the second period, the source driver XD outputs a video signal for one row, as video-level pixel voltages Vs, while each of the gate lines Y1 to Ym is being driven. Thereby, the source driver XD drives the source lines X1 to Xn in parallel. The pixel voltages Vs for one row are applied to the liquid crystal pixels PX of the selected row via the associated pixel switching elements W. The pixel voltages Vs for all the columns of liquid crystal pixels PX are set at the same polarities in the case of the frame-reversal drive scheme. To suppress the influence due to flicker and the like, in the case of the column-reversal drive scheme, the pixel voltages Vs for all the liquid crystal pixels PX are set at opposite polarities on a pixel-column-by-pixel-column basis, using the common voltage as a reference. Further, the video signals Vp for all the liquid crystal pixels PX are set at the opposite polarities every frame period, using the common voltage as a reference.

Figure 2:
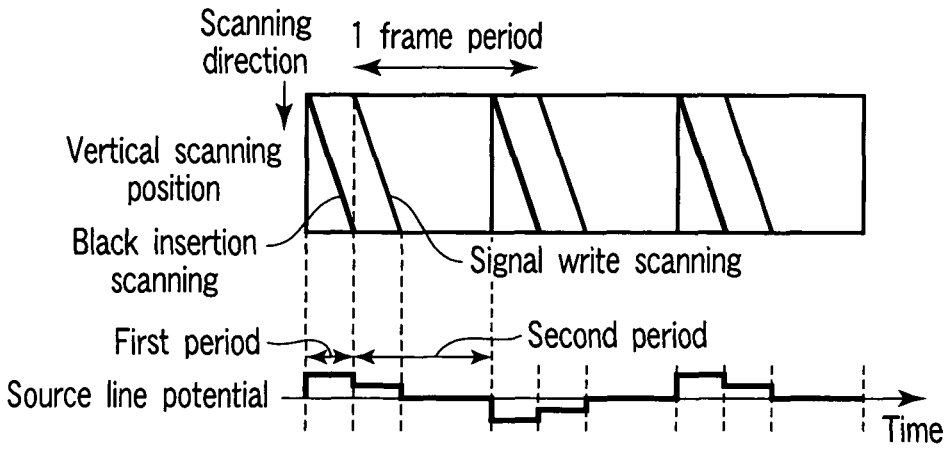
FIG. 2 is a view for explaining the operation of the liquid crystal display device shown in FIG. 1.

In this liquid crystal display device, the control by the control circuit 5 differs from a conventional control method in which the gate driver YD and source driver XD are controlled such that black insertion write is sequentially executed on all liquid crystal pixels PX by making use of a first half of each horizontal scanning period and video signal write is sequentially executed on all liquid crystal pixels PX by making use of a second half of each horizontal scanning period, whereby black insertion write and video signal write are alternately repeated. Specifically, as shown in FIG. 2, the control circuit 5 controls the gate driver YD and source driver XD such that black insertion write is sequentially executed on all liquid crystal pixels PX by making use of a first period and video signal write is sequentially executed on all liquid crystal pixels PX by making use of a second period, so as not to alternately repeat black insertion write and video signal write. In this case, as shown in FIG. 2, the source line potential does not vary at least in the black insertion scanning. In FIG. 2, the source line potential is depicted such that it does not vary even in the signal write scanning, but the source line potential depends on the pixel voltage level of the video signal that varies from pixel to pixel. However, even in the signal write scanning, the source line potential does not vary with polarity reversal. Therefore, both the improvement in moving image viewablity by the black insertion driving and the reduction in power consumption can be achieved.

It is necessary that the total time length of the first period and second period should not exceed one frame period. However, the ratio of the time length of the first period to the time length of one frame period is arbitrarily variable as a black insertion ratio. The first period and second period may be so set as to correspond to the first half and second half of one frame period. In this case, the black insertion ratio is 50%. The control circuit 5 is configured to determine, by itself, the lengths of the first period and second period. When the scanning periods for the black insertion scanning and the signal write scanning are set at the same value that is ¼ of one frame period, the black insertion ratio is variable within a range of 25 to 75%. Although the scanning periods for the black insertion scanning and the signal write scanning may differ from each other, it is preferable that they are set at the same value to simplify the circuit configuration. Further, it is preferable that the scanning periods for the black insertion scanning and the signal write scanning are short to expand the variable range of the black insertion ratio. It is more preferable that they are set to be equal to or shorter than ¼ of one frame period.

To effectively prevent reverse transition, the black insertion ratio may be changed to cope with a change in the temperature or illumination of a use environment.

In FIG. 2, the first period is set at about ¼ (25%) of one frame period, and the second period is set at the other about ¾ (75%) of one frame period. The scanning speed of the black insertion scanning and the scanning speed of the signal write scanning are equal. The black insertion scanning is completed in the first period, and the signal write scanning is completed in about first ⅓ (¼ of one frame period) of the second period that follows the first period. In the other ⅔ (¾ of one frame period) of the second period, the video-level pixel voltage Vs is continuously held in each liquid crystal pixel PX. In the meantime, although the signal write scanning begins immediately after the first period, the black-level pixel voltage Vs, which is written in each liquid crystal pixel PX of each row by the black insertion scanning, is held until the video-level pixel voltage Vs is written in the liquid crystal pixels PX of the associated row by the signal write scanning. In addition, although the next black insertion scanning begins immediately after the second period, the video-level pixel voltage Vs, which is written in each liquid crystal pixel PX of each row by the signal write scanning, is held until the black-level pixel voltage Vs is written in the liquid crystal pixels PX of the associated row by the black insertion scanning.

The above-described relationship between the first period (=25%) and second period (=75%) is merely an example. By making the first period shorter than the second period, a higher use efficiency of light can be obtained.

In order to complete each of the black insertion scanning and the signal write scanning within about ¼ (25%) of one frame period, it is necessary to set the scanning speed at a speed four times as high as that in the prior art. Such a high scanning speed of writing is attainable without lowering the aperture ratio when a poly-silicon (p-Si) thin-film transistor is used as the pixel switching element W. Further, in consideration of the scanning speed, an application to a liquid crystal display panel with such a resolution as is used in mobile products is easier than that to a liquid crystal display panel with a high resolution (the number of scanning lines is less than 500, for example).

The above-described embodiment is applicable to each of the column-reversal drive scheme and frame-reversal drive scheme. From the standpoint of power consumption, however, the frame-reversal drive scheme is more advantageous.

The reasons why the frame-reversal drive scheme is advantageous are as follows:

(1) In general, in the source driver for dot-reversal or column-reversal, the power (static power), which is consumed in addition to power necessary for charging and discharging source line loads, is greater than in the source driver for line-reversal or frame-reversal.

(2) In the frame-reversal, the polarity of the pixel voltage is the same in all the pixel columns for each frame period. Thus, with the common-reversal in which the common voltage Vcom is varied relative to the pixel voltage Vs, the power consumption of the source driver can be reduced by decreasing the voltage amplitude necessary for the driver operation.

If only the frame-reversal is used, attention needs to be paid since flicker, which is undesirable in terms of display quality, may become conspicuous. However, this problem can be solved by making an adjustment to the frame frequency, for example. As for the timing of the frame-reversal, the polarity may be reversed not only in units of one frame period, but also in units of plural frame periods in consideration of flicker.

As an intermediate scheme between dot-reversal (or line-reversal) and column-reversal (or frame-reversal), it may be possible to adopt a drive scheme in which polarity reversal is executed, for example, in units of k pixel lines (k=2, 3, 4, 5, 6, . . . ). In this drive scheme, the effect of reduction in power consumption as in the pure column-reversal (or frame-reversal) cannot be expected, but flicker can advantageously be reduced. However, in a pixel line immediately after polarity reversal is executed, the write quality of the pixel voltages differs from that in other pixel lines, and horizontal stripes may occur on the display screen. Taking this into account, it is preferable that the pixel voltages should be adjusted in a pixel line immediately after polarity reversal, for example.

In the present embodiment, the power consumption can be reduced by eliminating a repetition of polarity reversal which occurs due to an overlap between the write of the non-video signal (black-level pixel voltage Vs) for all the pixels PX and the write of the video signal (video-level pixel voltage Vs) for all the pixels PX. Further, in order to optimize the ratio of the non-video signal display to the video-signal display, the lengths of the first period and second period are adjustable relative to each other. Therefore, the display quality can be improved while low power consumption is maintained.

Figure 3:
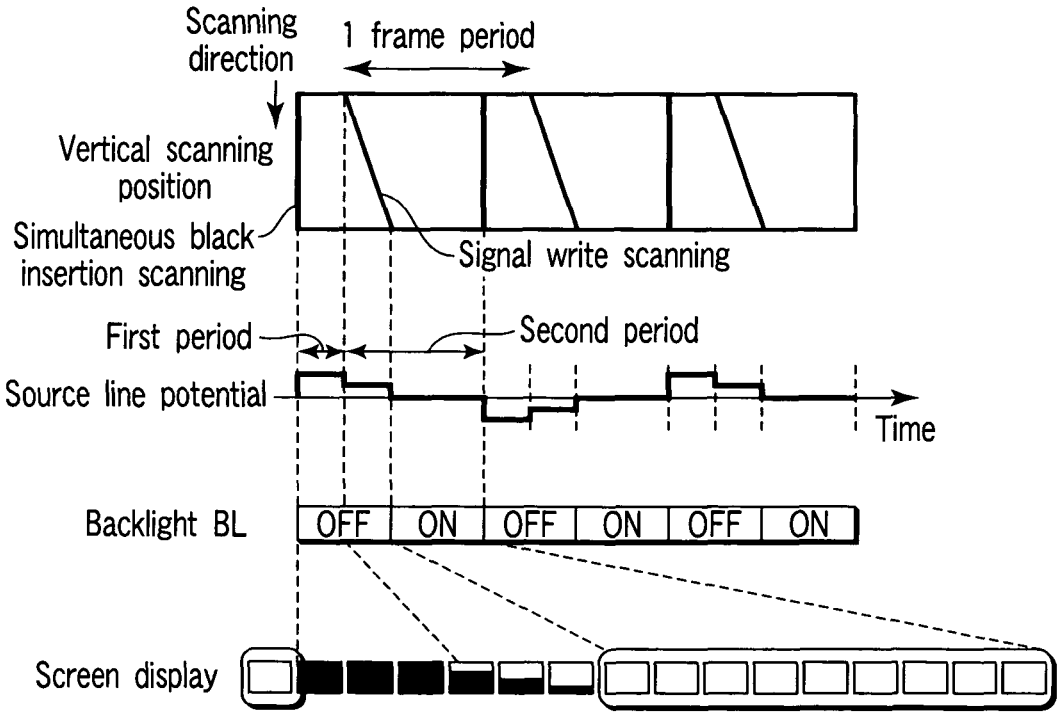
FIG. 3 is a view for explaining the operation of a liquid crystal display device according to a second embodiment of the invention.

Next, a liquid crystal display device according to a second embodiment of the invention is described. This liquid crystal display device is constructed in the same manner as in the first embodiment, except for the feature to be described below. FIG. 3 shows a scanning diagram and a source line potential waveform, which are obtained in the operation of this liquid crystal display device. In the description below, similar components as in FIG. 1 are denoted by the same reference symbols, and a detailed description thereof is omitted.

In this liquid crystal display device, the control circuit 5 controls the backlight driving unit LD to blink the backlight BL on and off in sync with the operation of the liquid crystal display panel DP. Specifically, the first period is set at about ¼ (25%) of one frame period, and the second period is set at the other about ¾ (75%) of one frame period. The black insertion scanning is executed simultaneously, and the non-video signal (black-level pixel voltages Vs) is applied to all the liquid crystal pixels PX for ¼ of one frame period. The signal write scanning is executed in about first ⅓ (¼ of one frame period) of the second period that follows the first period, and the video signal for the liquid crystal pixels PX is applied. In the other ⅔ (¾ of one frame period) of the second period, the video-level pixel voltage Vs is continuously held in each liquid crystal pixel PX. The backlight BL is kept on for ¾ of one frame period in which the video-level pixel voltages Vs are held in all the liquid crystal pixels PX. The backlight BL is kept off for the other periods, that is, in the black insertion scanning period and the signal write scanning period.

With this control, the following advantages can be obtained:

(1) Since the backlight BL is turned on after the video-level pixel voltages Vs are held in all the liquid crystal pixels PX, the use efficiency of the backlight BL can be improved. This use efficiency, in terms of time, is 75% in the operation shown in FIG. 2, but it becomes substantially 100% in the operation shown in FIG. 3.

(2) In the operation shown in FIG. 3, the screen is set in black display only in 50% of 1 frame period in which the backlight BL is kept off, and the screen is set in video signal display only in the other 50% of the 1 frame period. A luminance profile in this case becomes closer to an impulse type than in the case of the operation shown in FIG. 2 in which the screen is set in black display only in 25% of 1 frame period and the screen is set in video signal display only in the other 75% of the 1 frame period. Accordingly, the moving image viewablity can be improved. The moving image viewablity is expressed by using MPRT (Motion Picture Response Time) as an index, and the MPRT value decreases.

(3) In the turn-on period of the backlight BL, the signal write scanning is not performed. Thus, there is no need to vary the source line potential, and the source line potential can be set at a fixed value. Hence, even in the case of the column-reversal or frame-reversal drive scheme, there hardly arise such problems as capacitive coupling between the source line X and pixel electrode PE, vertical crosstalk due to off-leak current in the thin-film transistor, and a gradient in luminance.

(4) Since the backlight BL is kept off in the black insertion scanning period and signal write scanning period, the speed of the black insertion scanning and the speed of the signal write scanning do not need to be equal. It is thus possible to execute, as shown in FIG. 3, simultaneous black insertion scanning for the rows of all liquid crystal pixels PX, and to execute the signal write scanning with a sufficient time being secured in order to write the video-level pixel voltages. Thereby, the write quality of the video-level pixel voltages Vs are improved. In the meantime, in the operation shown in FIG. 2, the backlight BL is always in the on state. As a result, if the black insertion scanning and signal write scanning are not executed at the same speed, the signal display period in the frame period would vary from location to location in the screen, and this variation would be observed as a gradient in luminance. However, such a problem would not occur in the present embodiment.

In the present embodiment, the signal write scanning period is set to ¼ of one frame period. Thus, the black insertion ratio is changeable in a range of 5 to 75%. To effectively prevent reverse transition, the black insertion ratio may be changed to cope with a change in the temperature or illumination of a use environment.

Figure 4:
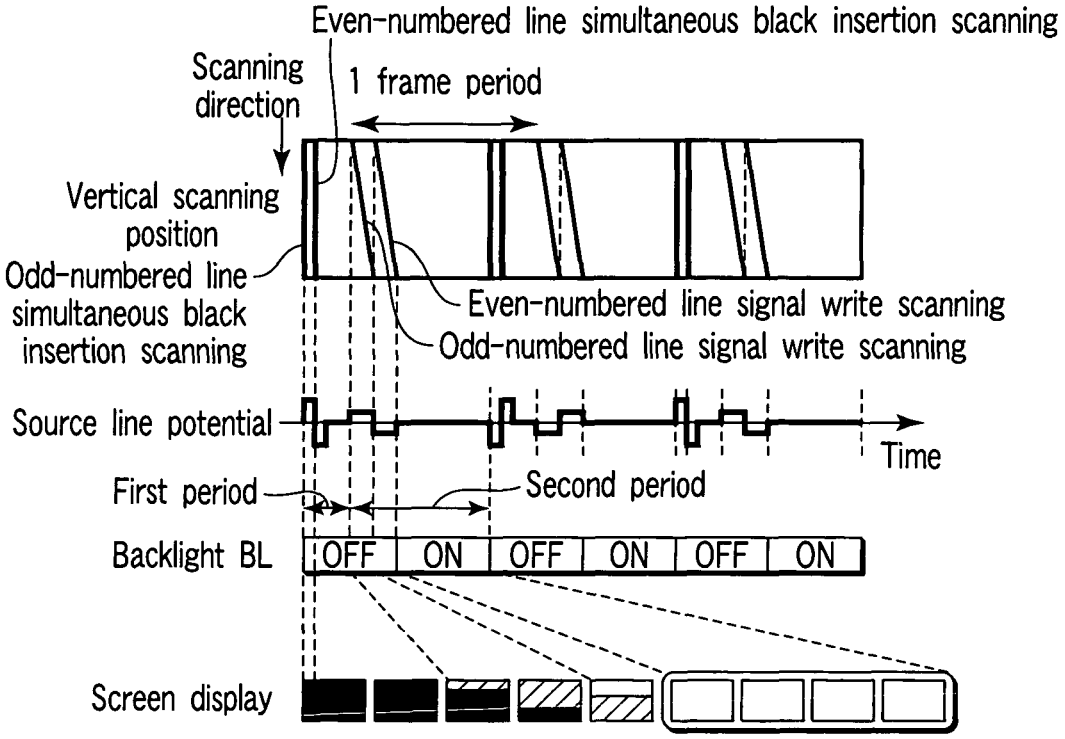
FIG. 4 is a view for explaining the operation of a liquid crystal display device according to a third embodiment of the invention.

Next, a liquid crystal display device according to a third embodiment of the invention is described. This liquid crystal display device is constructed in the same manner as in the first and second embodiments, except for the feature to be described below. FIG. 4 shows a scanning diagram and a source line potential waveform, which are obtained in the operation of this liquid crystal display device. In the description below, similar components as in FIG. 1 are denoted by the same reference symbols, and a detailed description thereof is omitted.

In this liquid crystal display device, as in the second embodiment, the control circuit 5 controls the backlight driving unit LD so as to blink the backlight BL on and off in sync with the operation of the liquid crystal display panel DP. Specifically, the backlight BL is kept on only for a period (¾ of one frame period) in which the video-level pixel voltages Vs are held in all the liquid crystal pixels PX. The backlight BL is kept off for the other periods, that is, in the black insertion scanning period and the signal write scanning period. Further, the control circuit 5 divides the rows (lines) of liquid crystal pixels PX into at least first and second groups, and controls the gate driver YD and source driver XD so as to repeat the black insertion scanning and signal write scanning in association with these groups. In this example, the liquid crystal pixels PX are divided into an odd-numbered line group comprising liquid crystal pixels PX of a 1st row, 3rd row, 5th row, 7th row, and an even-numbered line group comprising liquid crystal pixels PX of a 2nd row, 4th row, 6th row, 8th row, . . . . Each of the black insertion scanning and signal write scanning is executed in twice.

With this control, in the first period, the gate driver YD simultaneously drives odd-numbered gate lines Y1, Y3, Y5, . . . , so as to select odd-numbered rows of liquid crystal pixels PX as odd-numbered line black insertion scanning, and also simultaneously drives even-numbered gate lines Y2, Y4, Y6, . . . , so as to select even-numbered rows of liquid crystal pixels PX as even-numbered line black insertion scanning. While the gate lines Y1, Y3, Y5, . . . , are simultaneously driven by the odd-numbered line black insertion scanning, the source driver XD outputs a non-video signal for one row as black-level pixel voltages Vs. While the gate lines Y2, Y4, Y6, . . . , are simultaneously driven by the even-numbered line black insertion scanning, the source driver XD outputs a non-video signal for one row as black-level pixel voltages Vs, the polarity of which is set to be opposite to the polarity of the black-level pixel voltages Vs for the liquid crystal pixels PX of the odd-numbered rows.

In the second period that follows the first period, the gate driver YD sequentially drives the odd-numbered gate lines Y1, Y3, Y5, . . . , so as to sequentially select odd-numbered rows of liquid crystal pixels PX as odd-numbered line signal write scanning, and also sequentially drives the even-numbered gate lines Y2, Y4, Y6, . . . , so as to sequentially select even-numbered rows of liquid crystal pixels PX as even-numbered line signal write scanning. While each of the gate lines Y1, Y3, Y5, . . . , is driven by the odd-numbered line signal write scanning, the source driver XD outputs a video signal for one row as video-level pixel voltages Vs. While each of the gate lines Y2, Y4, Y6, . . . , is driven by the even-numbered line signal write scanning, the source driver XD outputs a video signal for one row as video-level pixel voltages Vs, the polarity of which is set to be opposite to the polarity of the video-level pixel voltages Vs for the liquid crystal pixels PX of the odd-numbered rows.

In this operation, the dot-reversal or line-reversal drive scheme can be executed in a pseudo-fashion in a scheme that is similar to a column-reversal or frame-reversal drive scheme in that the polarity of the source line potential is not varied in every 1 horizontal scanning period (1H).

According to this embodiment, while the power consumption due to charging and discharging of the source lines X is reduced, the flicker can be suppressed. As described in the first embodiment, the frame-reversal drive scheme is more advantageous than the column-reversal drive scheme from the standpoint of power consumption, but the problem of flicker easily occurs. However, flicker due to pseudo-line-reversal display can be suppressed by adopting the scheme of this embodiment in which each of the black insertion scanning and signal write scanning is executed in twice, in addition to the blinking of the backlight BL similar to the second embodiment.

The division of the rows of liquid crystal pixels PX is not limited to the above-described division into the odd-numbered line group and even-numbered line group. For example, the scanning may be executed twice by dividing the rows of liquid crystal pixels PX into a first group comprising liquid crystal pixels PX of a 1st row, 2nd row, 5th row, 6th row, 9th row, 10th row, . . . , in units of two rows, and a second group comprising liquid crystal pixels PX of a 3rd row, 4th row, 7th row, 8th row, 11th row, 12th row, . . . , in units of two rows. Further, the scanning may be executed three times by dividing the rows of liquid crystal pixels PX into a first group comprising liquid crystal pixels PX of a 1st row, 4th row, 7th row, . . . , a second group comprising liquid crystal pixels PX of a 2nd row, 5th row, 8th row, . . . , and a third group comprising liquid crystal pixels PX of a 3rd row, 6th row, 9th row, . . . .

Figure 5:
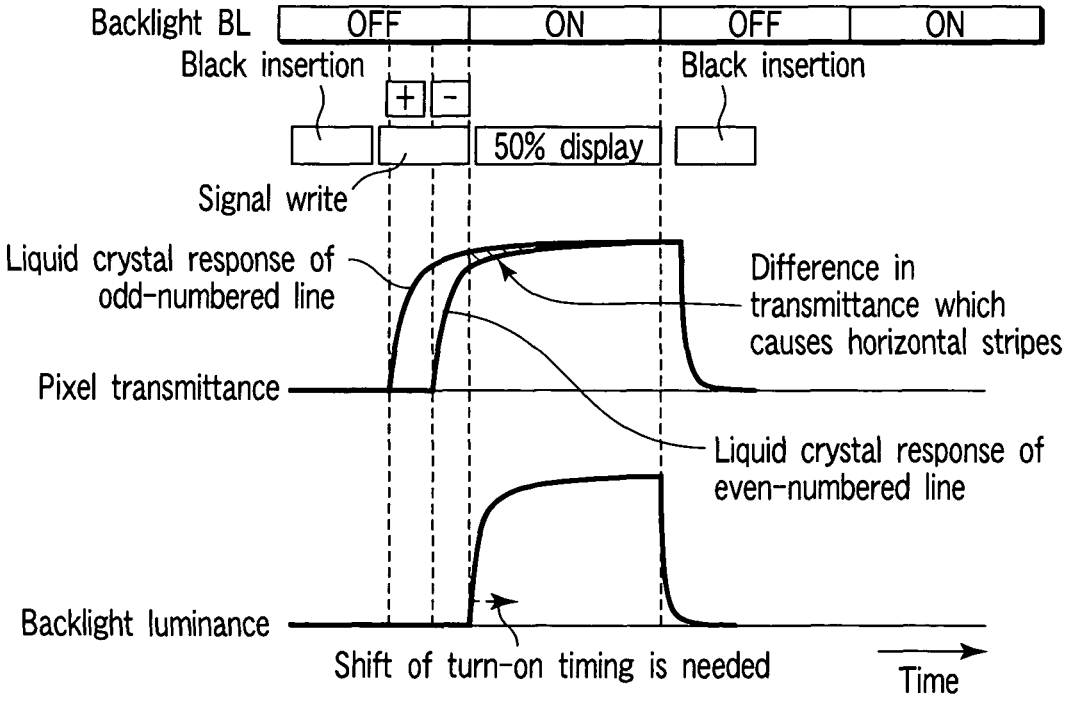
FIG. 5 is a view for explaining the cause of horizontal stripes, which occur due to a delay in liquid crystal response in the operation shown in FIG. 4.

The third embodiment is advantageous in that both the reduction in power consumption and the suppression of flicker can be achieved. However, horizontal stripes may easily occur in a case where the response speed of liquid crystal decreases due to very low temperatures. Such horizontal stripes occur in a case as illustrated in FIG. 5. For example, when attention is paid to the liquid crystal pixels PX of the first row (odd-numbered row) and second row (even-numbered row), the timing of the start of write in these pixels PX varies by a time difference between the odd-numbered line signal write scanning and the even-numbered line signal write scanning. If there is a delay in response of the liquid crystal, the transition of the pixel transmittance fails to be completed before turn-on of the backlight BL, and there occurs a difference in transmittance between the pixels PX of the odd-numbered row and the pixels PX of the even-numbered row. The difference in luminance due to this difference in transmittance is observed as the horizontal stripe. To make the difference in luminance less conspicuous, the turn-on timing of the backlight BL may be slightly delayed from that of scanning completion. However, this would decrease the brightness of the entire screen. Thus, it is desirable that luminance of the backlight BL be increased to cope with the problem.

Figure 6:
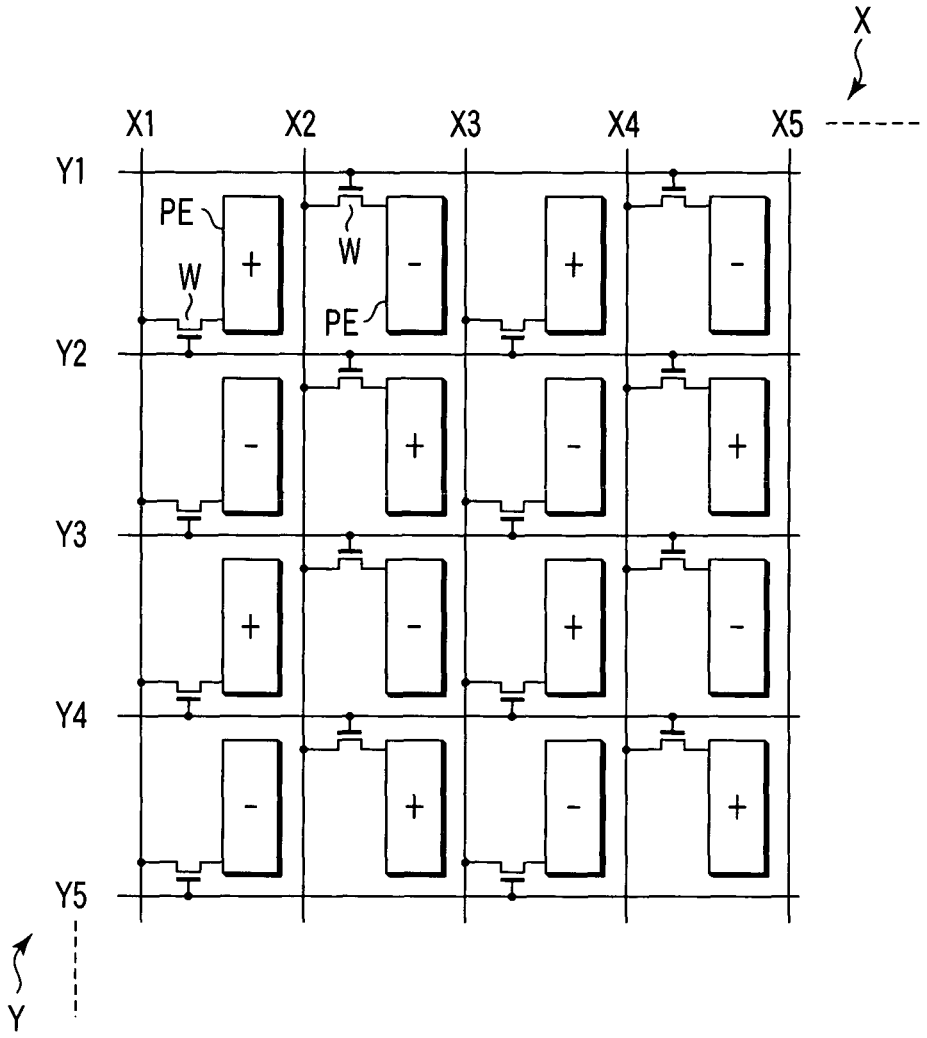
FIG. 6 shows the relationship of connection between pixel electrodes and gate lines, which is applied to a liquid crystal display device according to a fourth embodiment of the invention.

Next, a liquid crystal display device according to a fourth embodiment of the invention is described. This liquid crystal display device is constructed in the same manner as in the first embodiment, except for the feature to be described below. FIG. 6 shows the relationship of connection between the pixel electrodes PE and the gate lines Y, which is applied to this liquid crystal display device. In the description below, similar components as in FIG. 1 are denoted by the same reference symbols, and a detailed description thereof is omitted.

In this liquid crystal display device, as in the third embodiment, the control circuit 5 controls the backlight driving unit LD so as to blink the backlight BL on and off in sync with the operation of the liquid crystal display panel DP, and the control circuit 5 divides the rows (lines) of liquid crystal pixels PX into at least first and second groups and controls the gate driver YD and source driver XD so as to repeat the black insertion scanning and signal write scanning in association with these groups. The difference from the third embodiment is that gate lines Y, to which the gates of switching elements W for pixel electrodes PE are connected, are vertically reversed between neighboring columns. With this structure, in the case where the frame-reversal drive scheme, in which the polarities of the pixel voltages Vs for all columns are the same, is combined with interlaced scanning in which the lines of pixels are scanned by dividing these lines into an odd-numbered line group and an even-numbered line group, the pixels PX of the odd-numbered line and the pixels PX of the even-numbered line are vertically divided and driven in the first half and second half of the scanning. In other words, even if there is a difference in luminance due to a delay in liquid crystal response, such a difference in luminance is recognized as a checkered light/dark luminance pattern, which is less conspicuous than horizontal stripes. Hence, the display quality can be improved.

This scheme is very excellent since the dot-reversal display, which can most effectively suppress flicker, can be realized while executing the drive scheme which is similar to the frame-reversal that is most advantageous in terms of static power of the source driver XD and power consumption due to charging and discharging of the source lines X. As regards the pixel electrodes PE, the destinations of connection of the gates of switching elements W may not be reversed in units of a column, but may be reversed in units of, e.g., two columns or three columns.

Figures 7, 8:
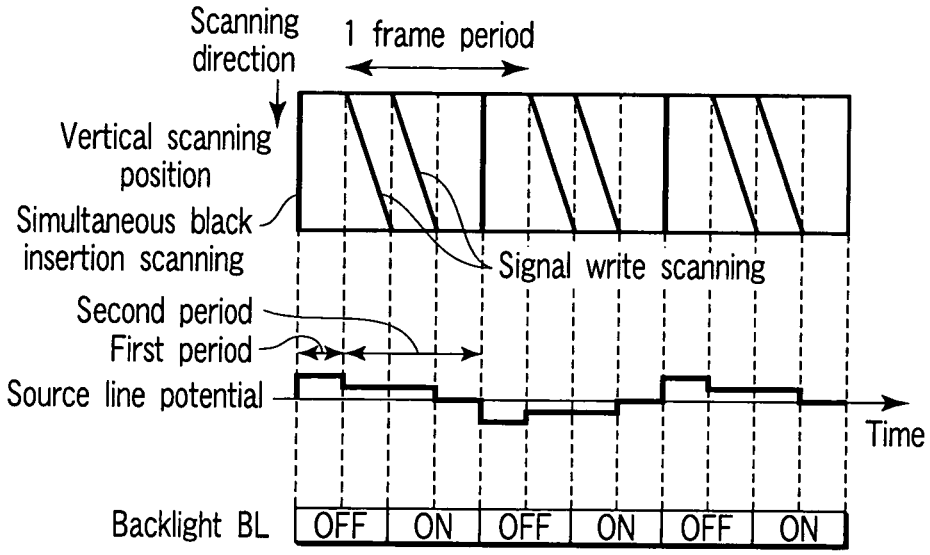
FIG. 7 shows a scanning diagram and a source line potential waveform, which are obtained in the operation of a liquid crystal display device according to a fifth embodiment of the invention.
FIG. 8 shows collected results of responses from all test subjects in connection with flicker in the state in which the frame frequency is increased in the first and second embodiments.

Next, a liquid crystal display device according to a fifth embodiment of the invention is described. This liquid crystal display device is constructed in the same manner as in the first and second embodiments, except for the feature to be described below. FIG. 7 shows a scanning diagram and a source line potential waveform, which are obtained in the operation of this liquid crystal display device. This liquid crystal display device executes, like the operations shown in FIG. 2 and FIG. 3, the black insertion scanning and signal write scanning for all the liquid crystal pixels PX in the first period and second period. In this liquid crystal display device, in particular, the signal write scanning is executed twice in the second period. The same signal as in the first signal write scanning is written in the second signal write scanning. The source driver XD repeats twice the operation of outputting a series of video signals to the liquid crystal pixels of the rows corresponding to the gate lines Y1 to Ym. In sync with the output of the video signal from the source driver XD, the gate driver YD repeats twice the operation of scanning the gate lines Y1 to Ym. In FIG. 7, the black insertion scanning is simultaneously executed for the rows of all liquid crystal pixels PX. Alternatively, the black insertion scanning may sequentially be executed for the rows of all liquid crystal pixels PX.

By adopting the scheme of this embodiment, the signal write time for one row can be substantially doubled. The adverse effect due to signal write deficiency (e.g., decrease in luminance) can be prevented. It has been described above that it would be difficult to apply the first embodiment of the invention to a high-resolution liquid crystal display panel.

However, the fifth embodiment of the invention is fully applicable to a high-resolution liquid crystal display panel.

The number of times of signal write scanning is not limited to twice, and it may be three times, four times, . . . . In FIG. 7, the second scanning is executed while the backlight BL is kept on. After the second or subsequent scanning is completed, the turning-on of the backlight BL may be started. The number of times of signal write scanning and the turn-on timing of the backlight BL may properly be set in consideration of the load on the source driver YD, the necessary luminance, etc.

As regards the first to fifth embodiments, in particular, in the case of executing the frame-reversal drive scheme, it is preferable to vary the common voltage Vcom on the common electrode CE with an opposite phase to the polarity of the pixel voltage Vs on the pixel electrode PE, which is applied from the source line X. Thereby, the voltage amplitude that is necessary for the driver operation of the source driver XD can be reduced, and the power consumption can be decreased.

The flicker, which is a possible problem in the first and second embodiments, can also be reduced by increasing the frame frequency from an ordinary value of 60 to 90 Hz or 120 Hz. In this case, however, a high scanning speed, which is six to eight times higher than a scanning speed in the conventional drive scheme, is necessary.

Actually, subjective evaluations of flicker were conducted by 30 test subjects. The test subjects observed the liquid crystal display panels DP of the first and second embodiments, which were driven in order to display images in the state in which the frame frequency was increased from the ordinary value of 60 Hz, and subjectively determined whether they were conscious of flicker. In the evaluations, the liquid crystal display panels DP each having a diagonal size of 4.3 inches and a number of pixels of 480×272 were used. Although it has been described above that the column-reversal drive scheme or frame-reversal drive scheme is preferable, the frame-reversal scheme was chosen in the evaluations, placing importance on power consumption. In the evaluations, display was made using a raster image of an intermediate gradation, in which flicker is most conspicuous. FIG. 8 shows collected results of responses from all test subjects. When the frame frequency was 70 Hz or less, there were subjects who were conscious of flicker with respect to the liquid crystal display panels DP of the first and second embodiments. On the other hand, when the frame frequency was 75 Hz or more, there were no subjects who were conscious of flicker. From the collected results, it is understood that it is preferable to set the frame frequency at 75 Hz or more in the case of executing the frame-reversal drive scheme in the first and second embodiments.

In the first to fifth embodiments, there are cases in which a gradient in luminance occurs due to a difference in transmittance response between the upper-end row and lower-end row on the screen, which is caused by a delay in liquid crystal response as shown in FIG. 5. Such a gradient in luminance can be suppressed by reversing the vertical scanning direction, in which the rows of pixels PX are selected, in every 1 frame period, for example, in such a manner that the scanning is executed from the upper-end row to the lower-end row in odd-numbered frames and the scanning is executed from the lower-end row to the upper-end row in even-numbered frames.

In the meantime, the present invention also has such an advantage that the reverse transition from the bend alignment of liquid crystal to the splay alignment can be prevented by making use of an OCB mode liquid crystal display panel.

In liquid crystal modes other than the OCB, such as a twisted nematic (TN) mode, an in-plane switching (IPS) mode and a vertically aligned (VA) mode, the excellent moving image viewablity as in the OCB mode cannot be obtained even if the drive schemes of the first to fourth embodiments are applied. For example, in the case of the drive scheme of FIG. 2, in the OCB mode, immediately after the completion of the black insertion write, the liquid crystal alignment transitions to the black state and is stabilized (i.e. the liquid crystal alignment state is reset). In other modes, since the response of the liquid crystal is slow, the liquid crystal alignment state is not stabilized even when the start time of the next signal write has come, and the signal write is executed while there remains the liquid crystal alignment state of the preceding frame. As a result, the image of the preceding frame remains as persistence. A ferroelectric liquid crystal and an antiferroelectric liquid crystal enable high-speed switching, but gradation display is difficult since they have two-value switching characteristics. Thus, in the first to fifth embodiments of the invention, the maximum advantageous effect can be obtained by using a liquid crystal such as an OCB liquid crystal or the like that enables gradation display corresponding to the degree of an applied voltage and has a quick response speed (tilt-up and tilt-down response) which is not longer than 10 msec, preferably not longer than 8 msec. In addition, the response speed (tilt-up and tilt-down response) of the OCB liquid crystal used in the embodiments was set at 7 msec, and a sufficient effect was obtained.

The backlight BL, which is used in the second to fifth embodiments, should preferably be an LED backlight or a short-persistence-type cold-cathode fluorescent lamp (CCFL) which has less persistence (i.e., with sharp rise or fall of luminance at the switching from off to on or from on to off). When the drive schemes of the first to fifth embodiments are to be executed, it is preferable that the liquid crystal display device be provided with a memory (frame memory) for storing video signals for one frame. This frame memory may be built to the source driver XD or may be built to the control circuit 5.

Next, a liquid crystal display device according to a sixth embodiment of the invention is described.

Figure 9:
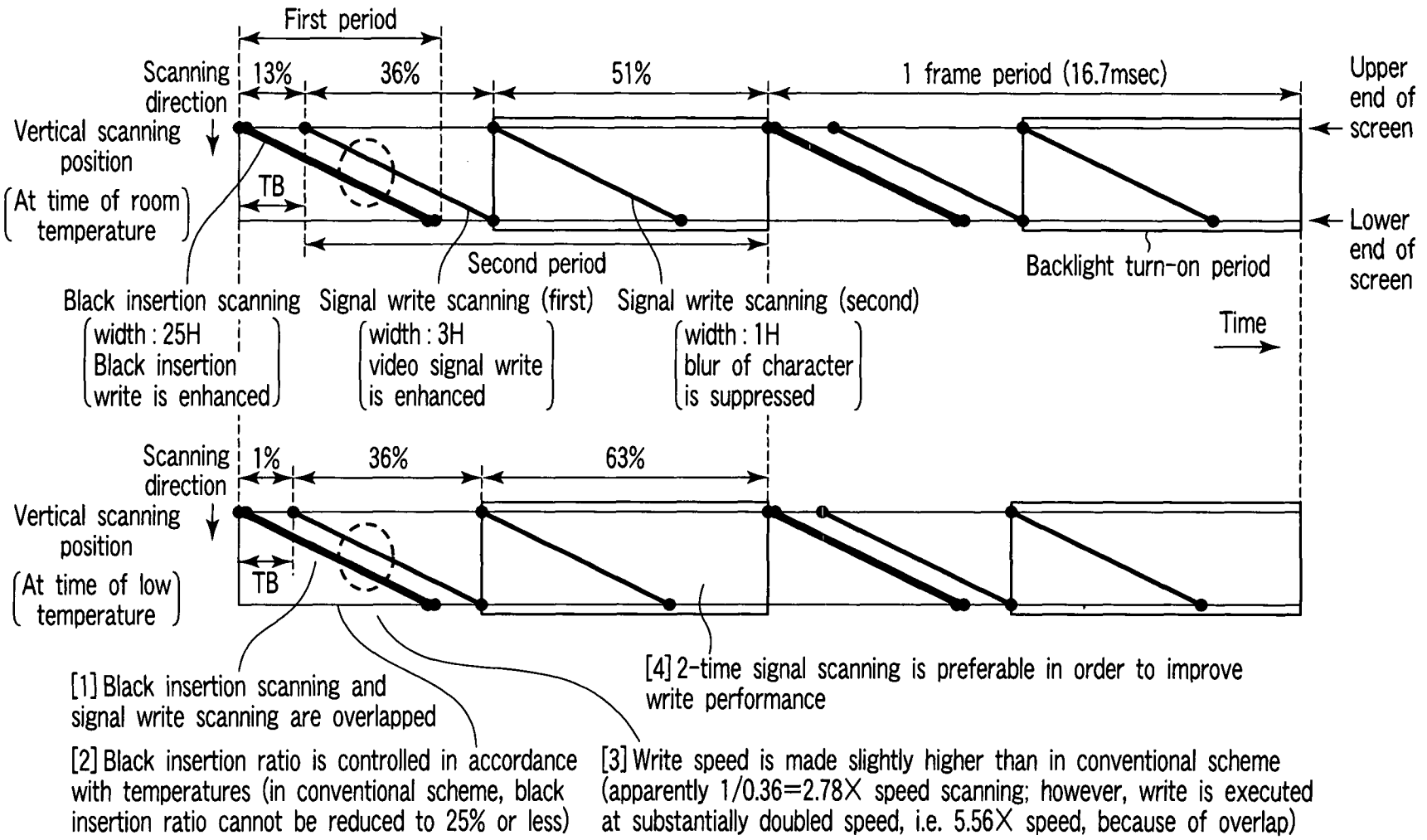
FIG. 9 shows driving timings in a liquid crystal display device according to a sixth embodiment of the invention.

FIG. 9 shows driving timings in the liquid crystal display device. The outstanding feature of the sixth embodiment differs from the first to fourth embodiments in that [i] the first period (black insertion period) and second period partly (signal write period and hold period) partly overlap, and [ii] the timing of the beginning of the second period, that is, the start timing of the signal write scanning, is controlled in accordance with temperatures.

Figure 10:
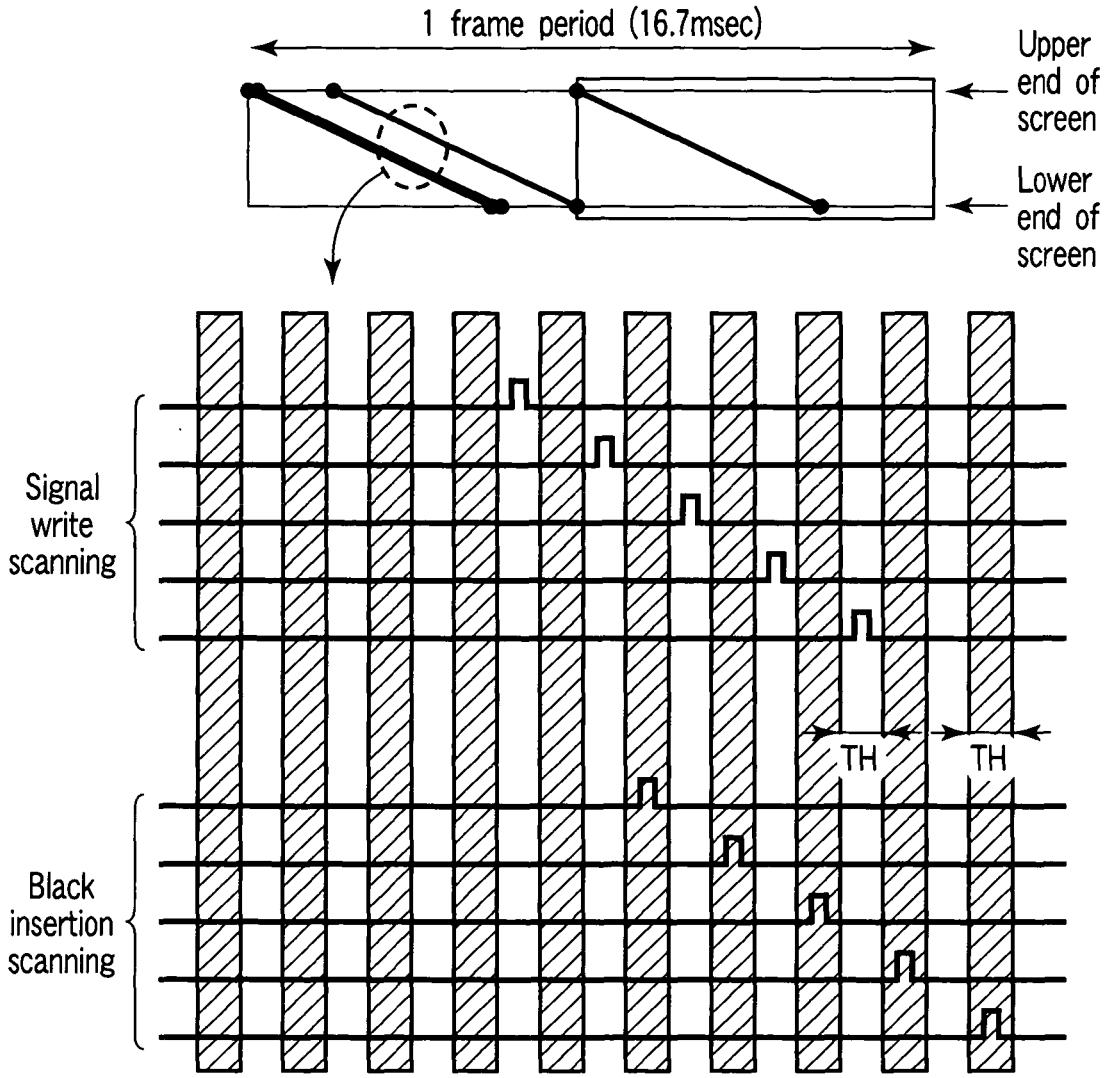
FIG. 10 is a view for explaining that black insertion scanning and signal write scanning are alternately performed in every 1 horizontal period in an overlap part of a first period and a second period in FIG. 9.

For example, as shown in FIG. 10, in the overlapping part of the first period and second period, the black insertion scanning and signal write scanning are alternately executed in every 1 horizontal period.

The concept of the timing setting in this method is as follows.

To begin with, a basic horizontal period (i.e. a write period TH in FIG. 10; the period TH for black insertion and the period TH for video signal write do not need to be equal in length, but these periods are set to be equal in FIG. 10 for the purpose of simple description), which is adequate to write a non-video signal for black insertion or a video signal in one pixel, is set. Then, the time necessary for scanning the screen from above to below (or from below to above) in the black insertion write or video signal write is calculated as 2×TH× the number of scanning lines. In the example of FIG. 9, the scanning time, which is thus calculated, is 36% of 1 frame.

The relative temporal relationship between the black insertion scanning and signal write scanning is determined as follows. If the start timing of the black insertion scanning is fixed at the beginning of the frame period, as shown in FIG. 9, the relative temporal relationship can be varied by varying the start timing of the signal write scanning. As a time period (to be referred to as "TB") from the start of the black insertion scanning (i.e. the beginning of the frame period) to the start of the signal write scanning is made shorter, a longer hold period can be secured and the luminance can be made higher. However, if the time period TB is extremely short, reverse transition would take place in the OCB liquid crystal. Thus, the period TB is set at a minimum possible value as far as no reverse transition occurs. In general, reverse transition tends to easily occur at high temperatures and hardly occur at low temperatures. Hence, in accordance with temperatures, the period TB is set to be longer at high temperatures and to be shorter at low temperatures. In FIG. 9, the conditions for non-occurrence of reverse transition are set, for example, such that the period TB is 13% of 1 frame at room temperature (~20° C.) and is 1% of 1 frame at low temperature (−20° C.).

The start of turn-on of the backlight BL is set at a timing of completion of the signal write scanning, and the end of turn-on of the backlight BL is set at a timing of the start of black insertion for the next frame (needless to say, these timings are not strict and some error may be tolerable). The timing of the start of turn-on is controlled in accordance with temperatures. In this example, the backlight turn-on period is 100%−(36%+13%)=51% at room temperature, and 100%−(36%+1%)=63% at low temperature.

As in the fifth embodiment of the invention, a second supplemental signal write scanning (i.e. write of the same video signal as in the first scanning) may be executed, as needed, during the backlight-on period. The second scanning can prevent adverse effect (e.g., decrease in luminance) due to deficient signal write.

Figure 11:
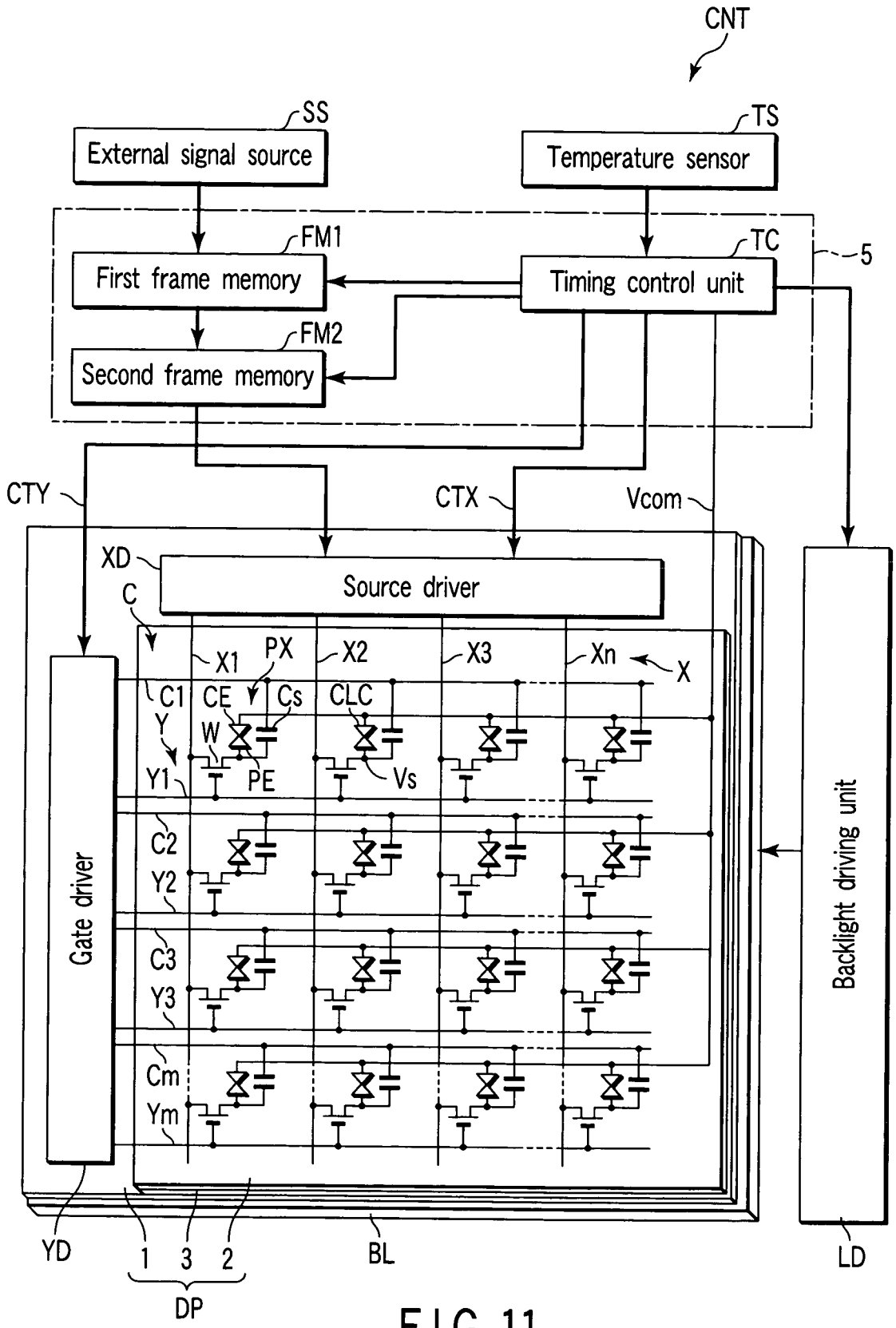
FIG. 11 is a block diagram of a liquid crystal display device in which a timing control is executed as shown in FIG. 9 and FIG. 10.

FIG. 11 is a block diagram showing a liquid crystal display device according to the present embodiment which implements the above-described timing control. The structure of this liquid crystal display device is a development of the structure shown in FIG. 1. This structure is characterized in that the control circuit 5 controls the drive timing by the above-described method in accordance with temperature information which is detected by a temperature sensor TS. Although not explicitly described in connection with FIG. 1, the control circuit 5 includes a timing control unit TC which controls the drive timings of the gate driver YD, source driver XD and backlight driving unit LD, and first and second frame memories FM1 and FM2 for storing video information.

Figure 12:
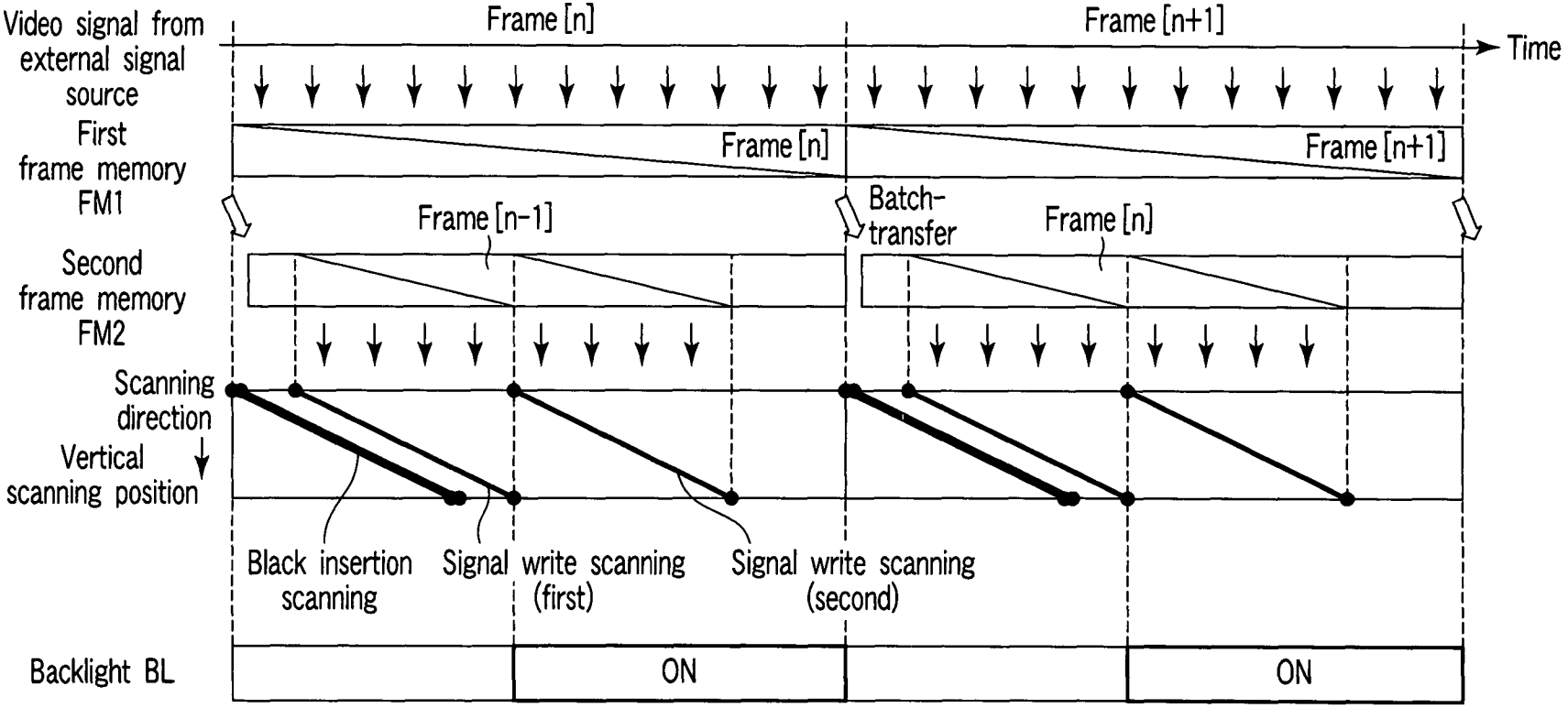
FIG. 12 is a view for explaining a scheme of signal transfer by first and second frame memories shown in FIG. 11.

The signal transfer of the frame memories FM1 and FM2 is described with reference to FIG. 12. The external signal source SS transfers video signals to the liquid crystal display device in time series. FIG. 12 illustrates the signal transfer for two frames (frame [n] and frame [n+1]).

In the frame [n] period, the external signal source SS outputs a video signal for one frame. During this period, the frame memory FM1 receives the video signal. At the end of the frame [n] period, all the video signal for one frame is stored in the frame memory FM1. Immediately thereafter, that is, at the beginning of the frame [n+1], the video signal in the frame memory FM1 is batch-transferred to the frame memory FM2. During the frame [n+1] period, the video signal is sequentially transferred from the frame memory FM2 to the source driver XD in sync with the timing of the scanning on the screen. Thus, the signal of the image corresponding to the frame [n] is written to the pixels. This operation is repeated in every frame cycle, and the moving image can be displayed on the screen with a delay of 1 frame.

In the first to fourth embodiments of the invention, the black insertion scanning and signal write scanning are temporally separated, and thus the time (corresponding to TB in FIG. 9) from the start of the black insertion scanning to the start of the signal write scanning cannot be set to be less than the time necessary for executing the black insertion scanning on the screen from above to below. In the sixth embodiment, there is no such restriction since the black insertion scanning and signal write scanning overlap, and the time from the start of the black insertion scanning to the start of the signal write scanning can be decreased to a lower limit value that is set for the prevention of reverse transition. Thereby, the backlight-on period is made expandable, and a higher luminance than in the first to fourth embodiments can be obtained.

Further, by taking advantage of the fact that reverse transition hardly occurs in the OCB mode at low temperatures, the backlight turn-on period is further expandable at low temperatures. In general, as the temperature falls, the luminance of the backlight BL lowers and also the response speed of liquid crystal decreases. As a result, the luminance of the display image tends to decrease. According to the sixth embodiment, such a decrease in luminance at low temperatures can be compensated, and an adequately bright image can be obtained even at low temperatures.

In the sixth embodiment, as shown in FIG. 10, the black insertion write and signal write are switched every period TH. Thus, the speed of signal transfer from the frame memory FM2 to the source driver XD may be about half the speed in the first to fourth embodiments, and the load on the control circuit 5 side is advantageously small (i.e. the operation frequency of the control circuit 5 can be decreased, and the circuit scale and power consumption can be reduced).

In the present scheme, since the source driver output is switched every period TH, the power consumption relating to charging and discharging of signal lines slightly increases. Thus, this drive scheme is suited to technical fields (e.g., car-mounted displays) in which the requirement for reduction in power consumption is not severe but a high luminance (in particular, at low temperatures) is required.

Figure 13:
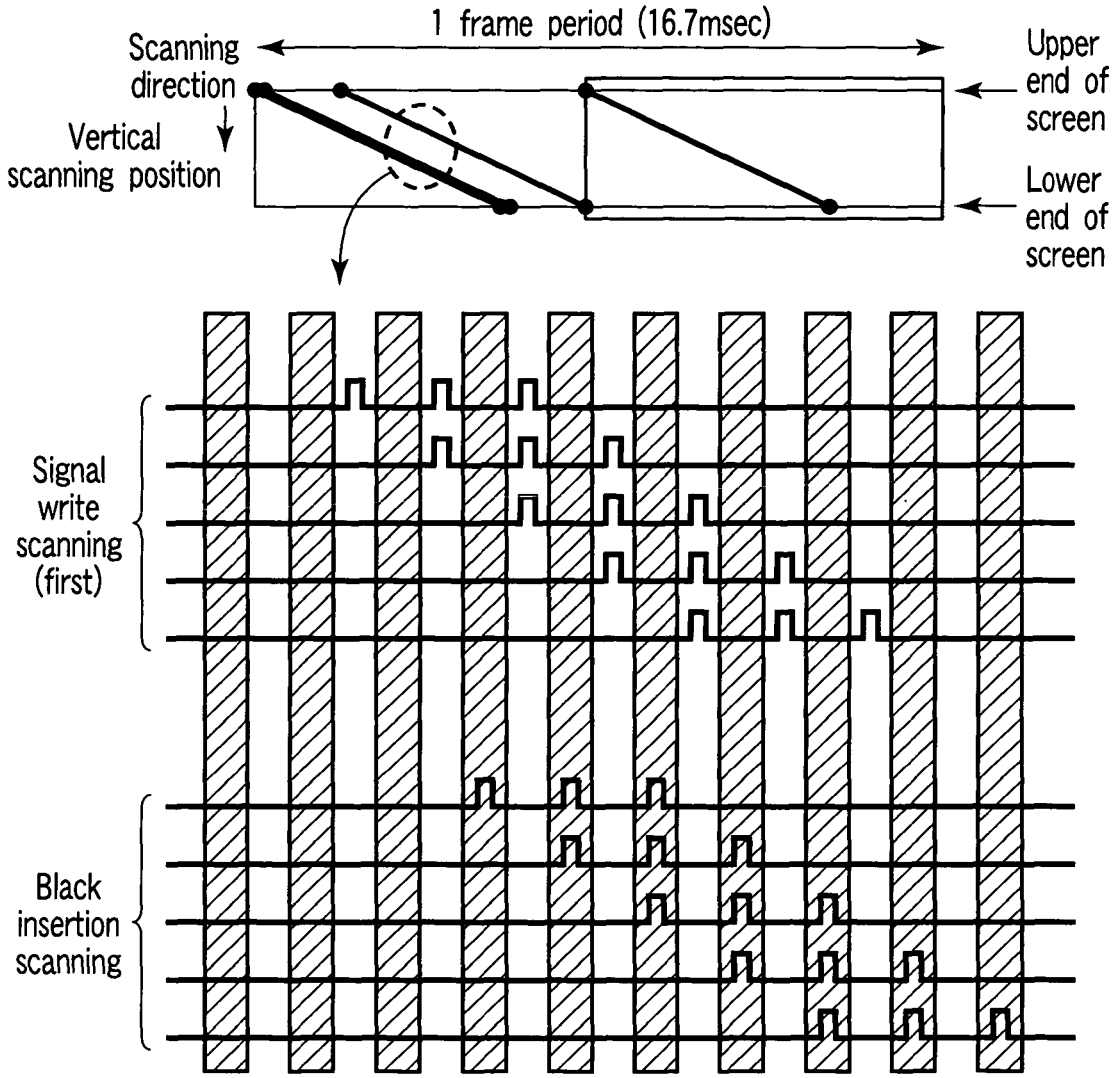
FIG. 13 shows an example in which the gate lines shown in FIG. 11 are driven a plurality of times in the black insertion scanning and signal write scanning.

In FIG. 10, each gate line is driven only once for a single scanning of each of the black insertion scanning and signal scanning. Alternatively, each gate line may be driven twice or more, as shown in FIG. 13 (in FIG. 13 each gate line is driven three times for each of the black insertion scanning and signal scanning). Thereby, the write quality can be improved, and the decrease in luminance due to deficient write can advantageously be prevented.

Figure 14:
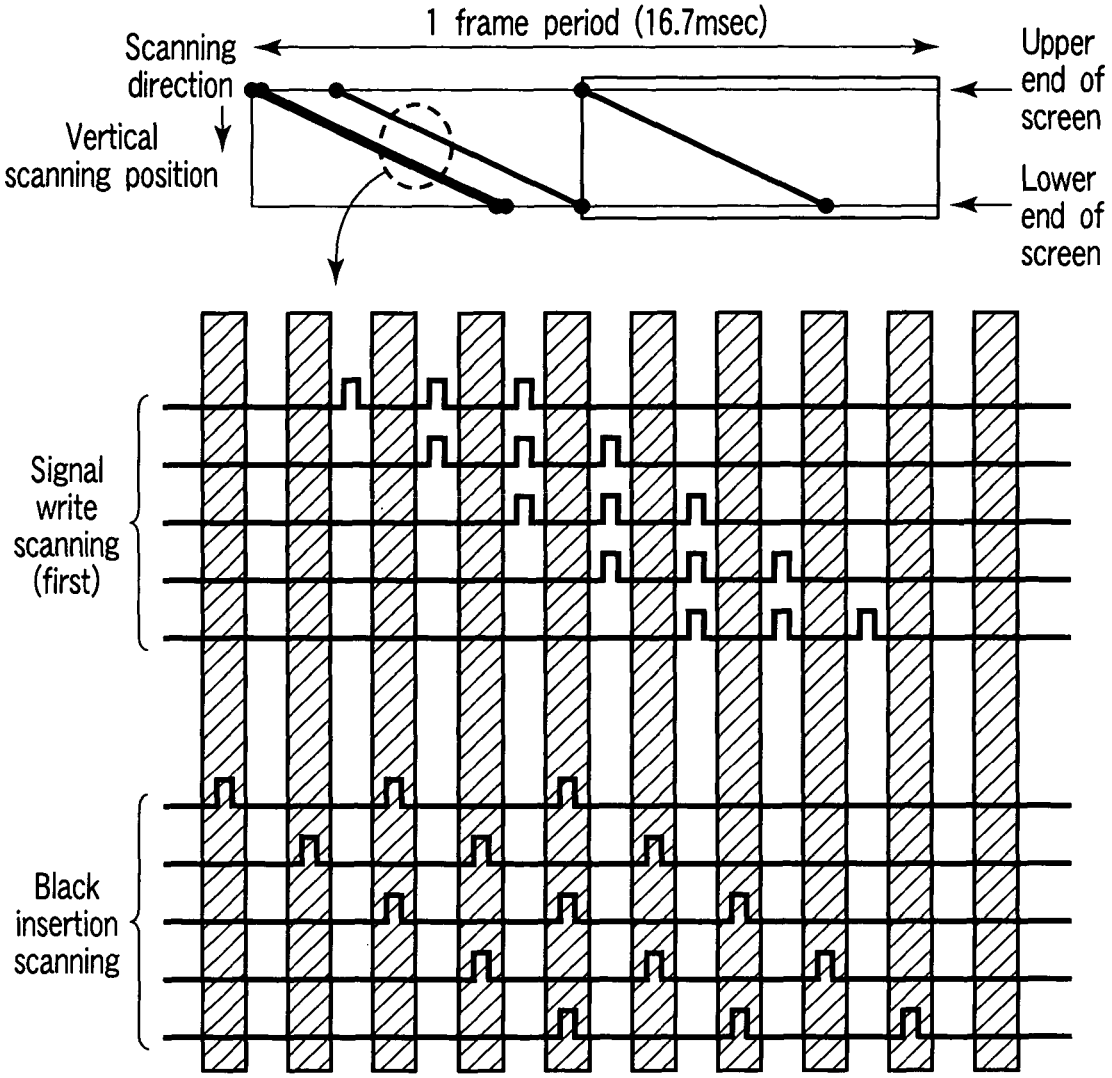
FIG. 14 shows an example in which the gate lines shown in FIG. 11 are driven a plurality of times with intervals in the range of several horizontal periods.
Figure 15:
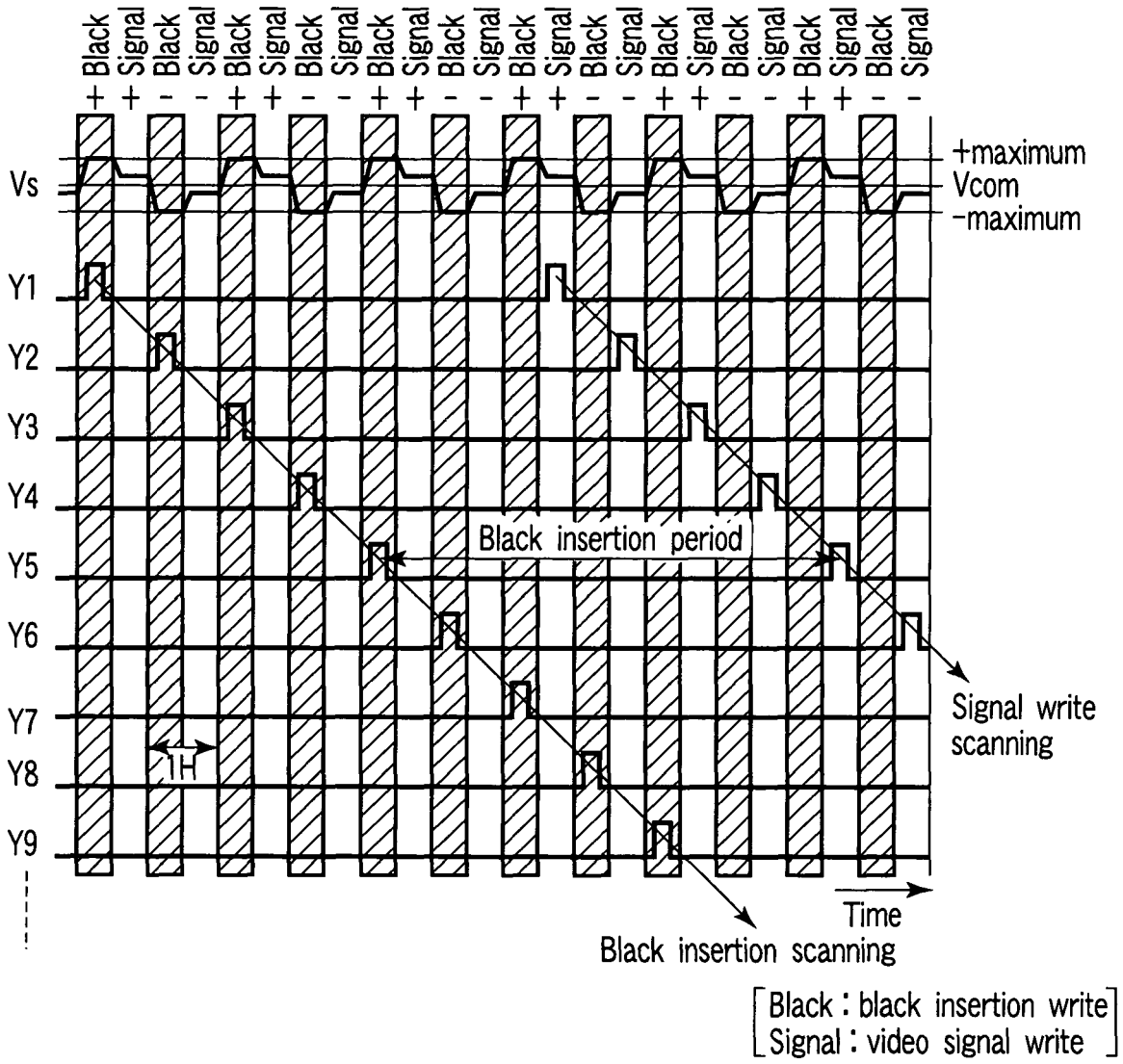
FIG. 15 shows timings of sequentially driving the gate lines for black insertion writing and video signal writing.
Figure 16:
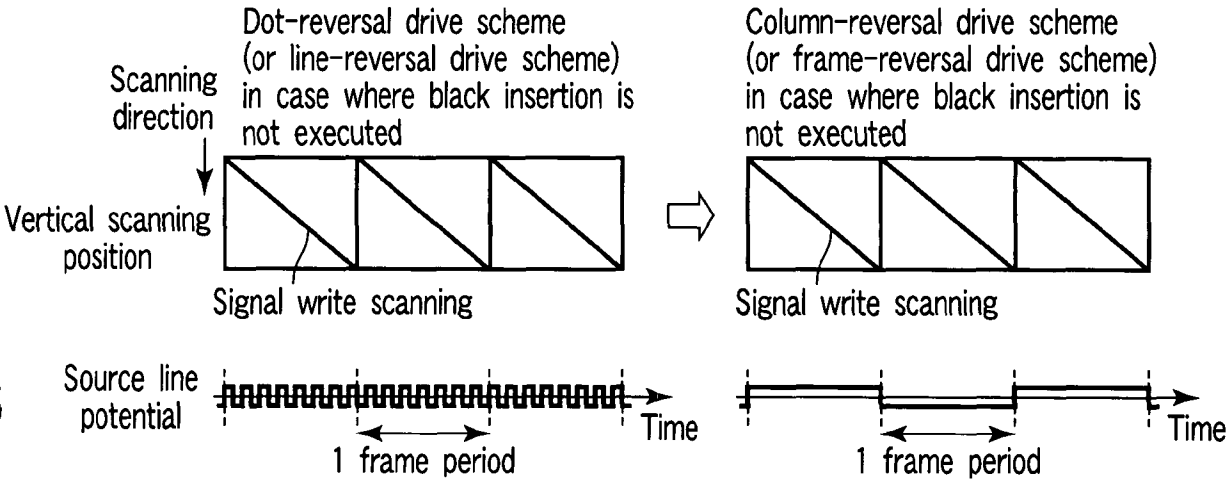
FIG. 16 shows a scanning diagram and a source line potential waveform, which are obtained in a prior-art driving in which black insertion is not performed.
Figure 17:
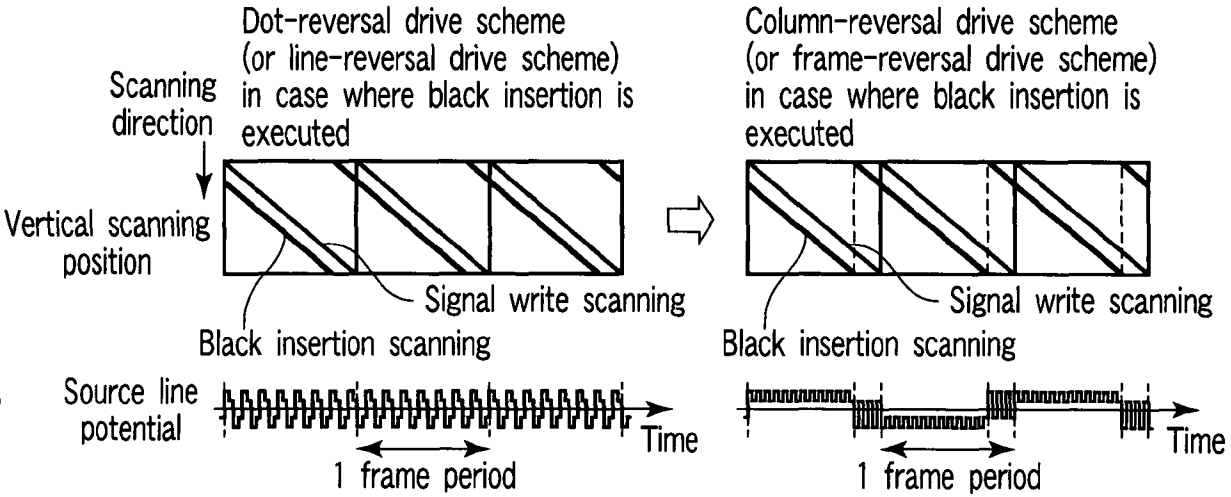
FIG. 17 shows a scanning diagram and a source line potential waveform, which are obtained in a prior-art driving in which black insertion is performed.

Furthermore, as shown in FIG. 14, the gate driver output may be switched so that gate pulses for driving may be discretely output in the range of several horizontal cycles (H). Thereby, it is possible to obtain a write enhancement effect by a liquid crystal transitional response in a period between subsequent two switchings (i.e. a dielectric constant in the direction of applied electric field increases by a transitional response of liquid crystal molecules to a voltage, and a greater quantity of charge is accumulated with the same applied voltage, and write quality apparently improved). With the same number of times of switching, higher write quality can be obtained than in FIG. 13. In general, the gate power consumption increases in proportion to the number of times of switching of the gate. In the scheme of FIG. 14, higher write quality can be obtained with the same power consumption as in FIG. 13.

In each of the above-embodiment, the liquid crystal display device is described as an example of a transmissive type display. The liquid crystal display device may be a transflective type display or the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A liquid crystal display device, comprising:

a plurality of OCB liquid crystal pixels which are arrayed substantially in a matrix and which include red, green and blue color filters;

a driver circuit which cyclically writes a non-video signal and a video signal as a pixel voltage in each of said liquid crystal pixels; and a control circuit which controls an operation timing of said driver circuit, wherein said control circuit is configured to set, in one frame period, a first period shorter than the frame period and a second period shorter than the frame period and partly overlapping the first period, and is configured to control the driver circuit to execute write of a black-level non-video signal for all of said liquid crystal pixels in the first period within a single frame period, to execute write of the video signal for all of said liquid crystal pixels in the second period within the single frame period, and to alternately execute the write of the non-video signal and the write of the video signal in units of one or more horizontal periods in an overlapping part of the first period and the second period, and is configured to reverse a polarity of the pixel voltage to the plurality of liquid crystal pixels in at least any one of column reverse and frame reverse and wherein a period from a start of the write of non-video signal to completion of the write of the video signal is equal to or shorter than the single frame period.

2. The liquid crystal display device according to claim 1, wherein said control circuit is configured to set a hold period of the pixel voltages in the second period after completion of the write of the video signal for all the liquid crystal pixels.

3. The liquid crystal display device according to claim 2, wherein a backlight source unit is provided for said liquid crystal pixels, and said control circuit is configured to control said backlight source unit such that said backlight source unit is kept on only for the hold period of the pixel voltages.

4. The liquid crystal display device according to claim 3, wherein a temperature sensor is provided to detect temperature information, and said control circuit is configured to change a start timing of the write of the video signal in accordance with the temperature information detected by the temperature sensor.

5. The liquid crystal display device according to claim 4, wherein said control circuit is configured to execute the write of the video signal twice or more in the second period, and to write the same video signals as in a first write of the video signal in second and following writes of the video signal.

6. The liquid crystal display device according to claim 5, wherein said control circuit is configured to select each of gate lines twice or more in at least one of non-video signal write scanning and video-signal write scanning.

7. The liquid crystal display device according to claim 6, wherein said selection of each gate line, which is executed twice or more in one scanning, is performed with an interval of one or more horizontal periods.

* * * * *